United States Patent [19]

Fauvel et al.

[11] Patent Number: 4,580,499

[45] Date of Patent: Apr. 8, 1986

[54] SCATTERABLE ANTI-TANK MINE WITH AUTOMATIC POSITIONING

[75] Inventors: Jean-Robert Fauvel, Muret; Philippe Rousseau, Paris; Pierre Thebault, Ramonville Saint Agne; Daniel Van Schendel, Muret, all of France

[73] Assignee: Etienne Lacroix Tous Artifices, Muret, France

[21] Appl. No.: 624,831

[22] Filed: Jun. 26, 1984

[30] Foreign Application Priority Data

Jun. 27, 1983 [FR] France ..... 83 10573

[51] Int. Cl.[4] ..... F42B 23/24

[52] U.S. Cl. ..... 102/401

[58] Field of Search ..... 102/401, 424, 425

[56] References Cited

U.S. PATENT DOCUMENTS

| | | | |
|---|---|---|---|
| 4,252,062 | 2/1981 | Auge | 102/401 |
| 4,391,198 | 7/1983 | Auge | 102/401 |

FOREIGN PATENT DOCUMENTS

| | | | |
|---|---|---|---|
| 69914 | 6/1982 | European Pat. Off. . | |
| 2071271 | 9/1971 | France | 102/401 |
| 2435690 | 4/1980 | France . | |

*Primary Examiner*—Charles T. Jordan

*Attorney, Agent, or Firm*—McCormick, Paulding & Huber

[57] ABSTRACT

A scatterable type of mine in accordance with the invention, comprises: a mine body (100) including an explosive charge enclosed in a generally flat casing including a bearing face (120) and an exposed face (110), the bearing face being in contact with the ground and the exposed face being turned upwardly when the mine is resting on the ground in the active position; a cover (200) having a contour similar to that of the mine body and placed on top of the mine body when in the closed position, the exposed face of the mine being under the cover and the cover being hinged to the mine body at a peripheral point thereof; locking means for keeping the cover closed; and opening means for unlocking the cover and exerting a pivoting torque thereon to move it from the closed position to a open position in which, after a relative rotation of about half a turn, the cover rests to one side of the mine body, the top face of the cover then being turned downwards and bearing on the ground; the pivoting torque being at equal to the torque that is required to overturn the mine body in the event that the mine was at rest prior to opening with its bearing face pointing upwards.

8 Claims, 3 Drawing Figures

SCATTERABLE ANTI-TANK MINE WITH AUTOMATIC POSITIONING

The present invention relates to an anti-tank mine for scattering.

BACKGROUND OF THE INVENTION

Mines of this type are to be distinguished from mines that are buried in the ground, for example by suitable digger equipment. Buried mines are intrinsically capable of being positioned with great accuracy in location, depth and orientation.

The same is not true of scatterable mines which, in contrast, are merely "broadcast", ie. thrown out onto the ground higgledy-piggledy from a point above the ground. The mines then fall to the ground where they may bounce and roll before coming to rest. Once they come to rest they must be in an active position, ie. both armed from the pyrotechnical point of view, and properly oriented relative to the ground.

To enable such mines to be properly oriented, a first type of scatterable mine is generally flat in shape, ie. its diameter is greater than its height. Such a mine thus has two large faces and a relatively narrow peripheral edge. Once on the ground it comes to rest on one of its large faces. A reversible arming system is thus provided, (eg. with a rocker member) so that the upwardly directed face is always the sensitive face of the mine. Such a mine solves the positioning problem, but does not lend itself to a wide range of possible charges, precisely because of its reversibility. This structure is furthermore generally restricted to small caliber scatterable mines.

In another type of scatterable mine, correct positioning is ensured by one or more arms for deploying after impact to right the mine so that its sensitive face points upwardly. However, because of their small area of contact with the ground, such arms do not always achieve the proper position, particularly on rough ground or on muddy ground (where they tend to sink in).

Preferred embodiments of the present invention reduce these drawbacks.

SUMMARY OF THE INVENTION

The present invention provides a scatterable type of mine comprising:

a mine body including an explosive charge enclosed in a generally flat casing including a bearing face and an exposed face, the bearing face being in contact with the ground and the exposed face being turned upwardly when the mine is resting on the ground in the active position;

a cover having a contour similar to that of the mine body and placed on top of the mine body when in the closed position, the exposed face of the mine being under the cover and the cover being hinged to the mine body at a peripheral point thereof;

locking means for keeping the cover closed; and opening means for unlocking the cover and exerting a pivoting torque thereon to move it from the closed position to a open position in which, after a relative rotation of about half a turn, the cover rests to one side of the mine body, the top face of the cover then being turned downwards and bearing on the ground;

the pivoting torque being at least equal to the torque that is required to to overturn the mine body in the event that the mine was at rest prior to opening with its bearing face pointing upwards.

In this manner, the body of the mine is advantageously flat in shape, but does not need to be reversible. It comprises a sensitive face (hereinafter referred to as the "exposed" face, and located on the opposite side of the mine to the "bearing" face by which the mine rests on the ground) which will always finish by pointing upwards. Thus, after impact and subsequently coming to rest, either the mine body is already the right way up, ie. with the exposed face uppermost, so that opening the cover simply acts to expose the exposed face, or else the mine body comes to rest upsidedown ie. with the exposed face pointing downwards, in which case opening the cover provides sufficient impulse to turn the mine body over so that is is then the right way up.

The cover preferably includes an upwardly directed rim which, in the closed position, acts as an extension of the side wall of the mine. This serves to cause the center of gravity of the mine-and-closed-cover assembly to be off-centered downwardly, giving the assembly a preferential position of stable equilibrium when on the ground in which the cover is on top and the body of the mine is underneath. The bearing face of the mine body is preferably convex and circularly symmetrical.

In this manner, the mine's equilibrium about the correct position (exposed face upwards) is made highly stable since the off-center center of gravity tends to tip the mine into this position rather than the other way. In particular, if the mine is standing on its edge and possibly rolling on the ground, it will have a marked tendency to come to rest on its bearing surface rather than on its cover.

Advantageously, the cover includes a continuous surface which completely covers the exposed face of the mine while the mine is in the closed position, thereby acting as a protective shield for the exposed face.

In addition to the two above-mentioned functions of displacing the center of gravity downwards and of increasing the ground contact area (after opening), the cover also performs a third function of protecting the exposed face prior to opening, ie. during storage, during scattering, and for the period between impact and finally coming to rest.

It is also advantageous for the rim to be of such a size and height as to constitute a receptacle which is complementary to the bearing surface of the mine body so as to enable a plurality of identical mines to be stacked, with the rim of one mine at least partially housing the body of the next mine.

This feature of a female cover shape receiving a male mine body shape thus constitutes a fourth or stacking function for the cover. This feature is particularly advantageous given that by their very nature scatterable mines tend to be used in large numbers, and therefore need to be stored as rationally as possible.

The mine preferably includes impact detector means for detecting its impact on the ground and for controlling the operation of the cover opening means. The mine should also include time delay means triggered by the impact detector means to define the moment at which the cover opening means are operated relative to the time of impact.

This makes it possible to ensure that the cover is opened and the pyrotechnical chain of the mine is armed only after sufficient time has elapsed to be reasonably certain that the mine has come fully to rest. The specific time setting will depend, inter alia, on the height from which the mines are scattered and on the nature of the ground on which they fall.

Finally, the mine is advantageously a shaped charge mine, eg. a plate projection mine comprising a concave metal plate serving as a projectile and having its inside face (ie. its convex face which is inside the mine body) in direct contact with the explosive charge. This type of mine is quite conventional and serves to maximize the effects obtained with a minimum amount of explosive. Since the detonation propagates radially from the firing point, the metal plate begins by deforming in the middle at the same time as being accelerated, thereby constituting a point effect missile.

BRIEF DESCRIPTION OF THE DRAWINGS

An embodiment of the invention is described by way of example with reference to the accompanying drawings, in which.

MORE DETAILED DESCRIPTION

Figure 1:
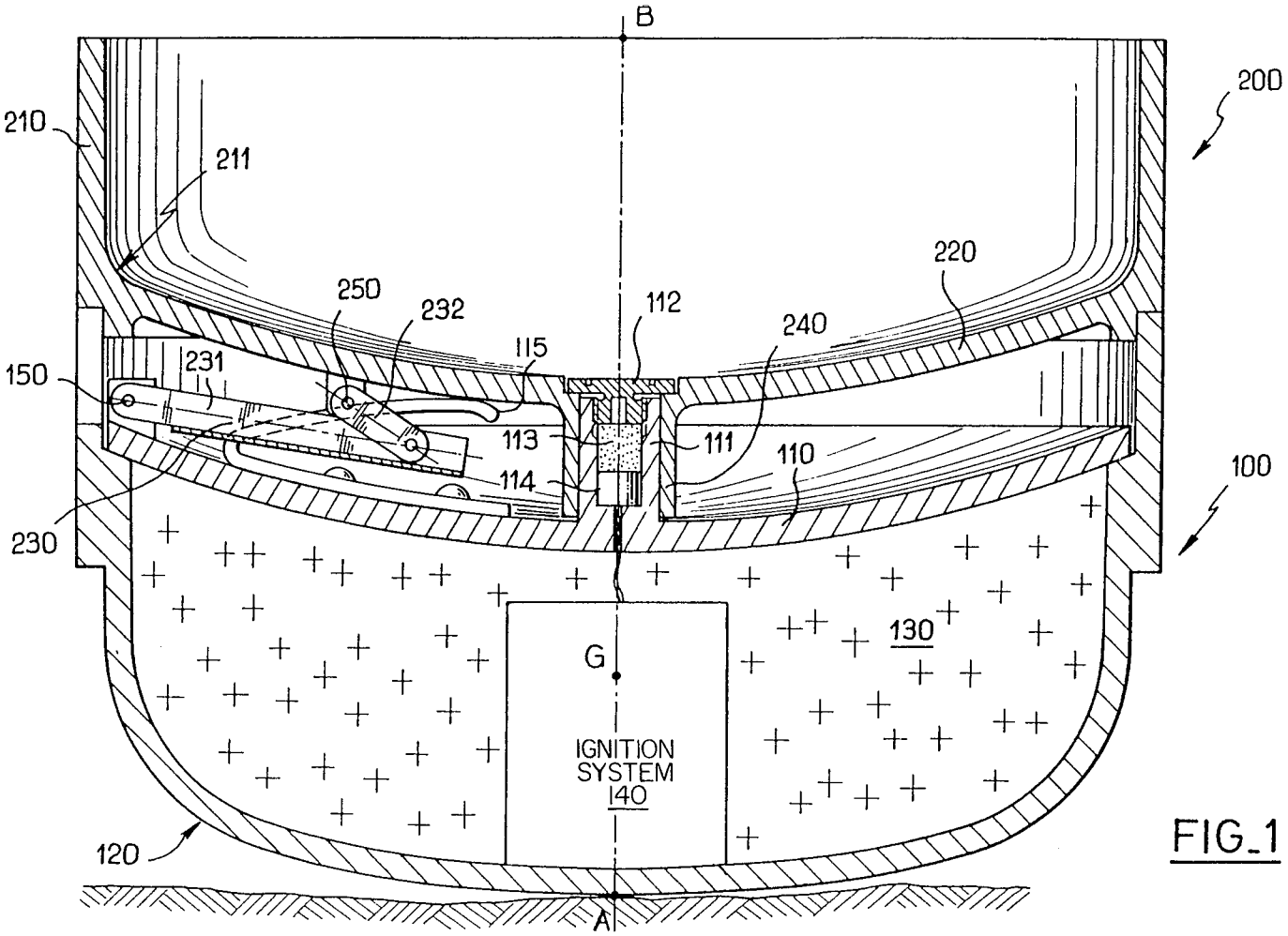
FIG. 1 is an axial section through a mine in accordance with the invention, resting on the ground and in the closed position, prior to opening.

FIG. 1 shows the body of a mine 100 covered by its cover 200 prior to opening.

The mine body 100 comprises a casing, eg. of synthetic material, closed by a metal plate 110 which constitutes the exposed face of the mine, ie. the face which is always pointing upwards when the mine is activated. The plate 110 is generally concave in shape, and its face inside the mine body is in direct contact with the explosive charge 130 in the conventional manner for a plate projecting mine.

The under surface 120 of the mine body which is applied against the ground when the mine is in the activated position is generally convex in shape, being of circular symmetry about a substantially vertical axis and sloping away gradually from its center A to the side of the mine.

The explosive 130 enclosed inside the mine body is a shaped charge explosive. An ignition system 140 is provided which, in addition to pyrotechnical means for initiating an explosion, includes detector means (eg. electronic means), for detecting the passage of an armored vehicle, eg. by inductive effects. The ignition system 140 is preferably programmable, and is connected to a power supply just prior to the mines being scattered.

The ignition system 140 also includes impact detector means to detect the mine's impact with the ground, together with time delay means which are triggered by the impact detector means, to arm the pyrotechnical chain of the mine at a suitable instant after impact. A suitable time delay corresponds to the maximum expected time for the mine to come to a complete halt. It is shown later that the same time delay means can be used to time the opening of the mine cover.

The cover 200 includes a surface 220 which, in the closed position, completely covers the exposed face 110 of the mine body. This surface extends radially overall and further extends axially upwardly in the form of a generally cylindrical rim 210, thereby enabling:

the mine's bearing surface on the ground to be maximized once the cover is deployed;

the mine's center of gravity G to be moved off-center when the cover is in the closed position, thereby giving a preferential stable equilibrium position with the cover uppermost: this causes the cover 200 to be much lighter than the mine body 100, and the center of gravity G of the mine-and-closed-cover assembly is much closer to the end A of the mine body than it is to the top B of the cover; and the upper surface 211 of the cover to have a female shape which matches the male shape of the lower surface 120 of the mine body, thus making the mines stackable.

The cover 200 is connected to the body of the mine 100 by an articulated arm 230 extending between a peripheral point 150 of the mine body and a point 250 on the cover. The articulated arm, eg. comprising two links 231, 232, is deployable in such a manner (as is explained below) that in the open position the assembly constituted by the arm and the cover holds the exposed face of the mine body in a generally horizontal configuration.

In the closed position, the cover is locked to the mine body, eg. by a hollow portion 240 fitting over a projecting portion 111 of the exposed face 110. An explosive bolt 112 is then screwed into the projecting portion to hold down the cover 200. After the mine has come to rest on the ground, and for example under the control of the ignition means and the time delay means 140, a charge 113 is ignited by a detonator 114 causing the bolt 112 to explode.

Figure 2:
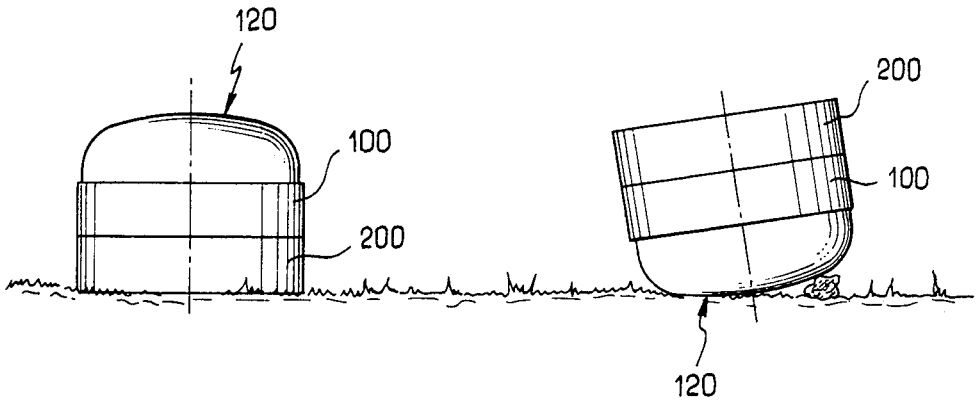
FIG. 2 shows two possible positions in which the mine may come to rest before opening.

FIG. 2 shows two possible positions in which the mine may come to rest on the ground before opening: most often the mine comes to rest the right way up because of its off-center center of gravity (due to the hollow cylindrical rim 210 on the cover) and because of its convex bearing surface 120. This position is shown to the right of FIG. 2 in which the bearing surface 120 can be seen to be in contact with the ground.

However, the mine may (if rarely) come to rest upsidedown as shown to the left of FIG. 2, ie. with the bearing surface 120 uppermost and with the cover 200 resting on the ground.

Figure 3:
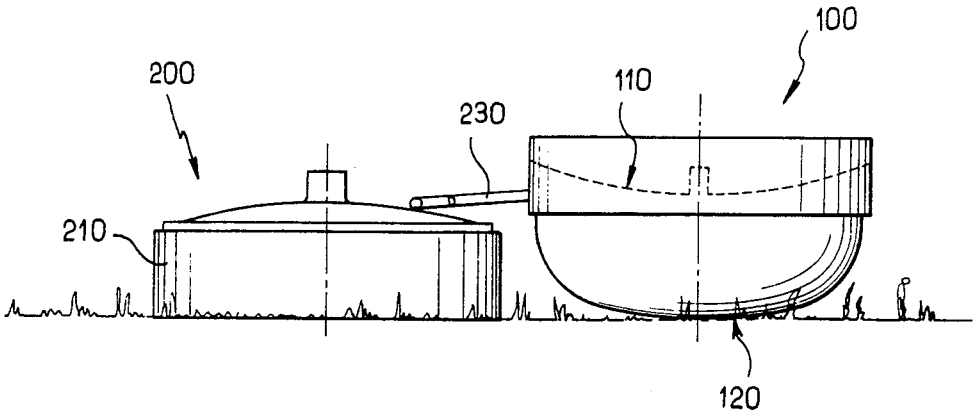
FIG. 3 shows the mine on the ground after opening and in the active position.

After the time delay has expired, the explosive bolt 112 is expelled, thus unlocking the cover. Opening means, which may comprise mechanical means such as a spring 115 or else explosive means, apply a pivoting torque tending to cause the mine to move from its closed position (FIG. 2) to its open position (FIG. 3). This requires the cover 120 to move through about half a turn (ie. about 180°) relative to the body 100 of the mine.

If the mine comes to rest the right way up (right hand side of FIG. 2), opening the cover simply uncovers the exposed face 110 of the mine body and increases the ground contact area by means of the rim 210 resting on the ground. The size of the articulated arm 230 and of the movement it can perform are so chosen that the exposed face 110 of the mine body remains in a generally horizontal position so that this face, which is the sensitive face, is oriented in the most effective manner.

However, if the mine comes to rest upsidedown (left hand side of FIG. 2) the opening means exert their pivoting torque on the body 100 of the mine, and the torque is great enough to ensure that the body is turned over. In this case, the cover 200 stays in place pressing on the ground, while the mine body 100 is moved to a point adjacent to the cover, where it finally comes to rest the right way up.

We claim:

1. A scatterable type of mine comprising:

a mine body including an explosive charge enclosed in a generally flat casing including a bearing face and an exposed face, the bearing face being in contact with the ground and the exposed face being turned upwardly when the mine is resting on the ground in the active position;

a cover having a contour similar to that of the mine body and placed on top of the mine body when in the closed position, the exposed face of the mine being under the cover and the cover being hinged to the mine body at a peripheral point thereof;

locking means for keeping the cover closed; and opening means for unlocking the cover and exerting a pivoting torque thereon to move it from the closed position to a open position in which, after a relative rotation of about half a turn, the cover rests to one side of the mine body, the top face of the cover then being turned downwards and bearing on the ground;

the pivoting torque being at least equal to the torque that is required to to overturn the mine body in the event that the mine was at rest prior to opening with its bearing face pointing upwards.

2. A mine according to claim 1, wherein the cover includes a rim which, when the mine is in the closed position, extends the side walls of the mine upwardly in such a manner as to off-set the center of gravity of the mine-and-closed-cover assembly downwards to give the said assembly, when resting on the ground, a preferred position of stable equilibrium in which the cover is pointing upwards.

3. A mine according to claim 2, wherein the bearing face of the mine body is convex in shape and has circular symmetry.

4. A mine according to claim 2, wherein the size and the height of the rim define a shape which is complementary to the bearing face of the mine body in such a manner as to enable a plurality of identical mines to be stacked, with the rim of one mine receiving, at least partially, the body of the adjacent mine.

5. A mine according to claim 1, wherein the cover includes a continuous surface which completely covers the exposed face of the mine body when the mine is in the closed position, thereby constituting a protective shield for the exposed face.

6. A mine according to claim 1, wherein the mine is a shaped charge and plate projection mine, with the exposed face of the mine body comprising a concave metal plate forming a projectile whose inside face is in direct contact with the explosive charge.

7. A mine according to claim 1, wherein the cover is connected to the body of the mine by an articulated arm which is deployable in such a manner that, when in the open position, the assembly constituted by the arm and the cover hold the exposed face of the mine body in a generally horizontal position.

8. A mine according to claim 1, wherein the locking means are pyrotechnical includes an explosive bolt holding on the cover and keeping it fixed to the mine body when in the closed position.

* * * * *